US009283488B2

(12) United States Patent
Fens

(10) Patent No.: US 9,283,488 B2
(45) Date of Patent: Mar. 15, 2016

(54) BELT TIRE SWING

(71) Applicant: M&M Sales Enterprises Inc., Dubuque, IA (US)

(72) Inventor: Ryan J. Fens, Dubuque, IA (US)

(73) Assignee: M&M Sales Enterprises Inc., Dubuque, IA (US)

( * ) Notice: Subject to any disclaimer, the term of this patent is extended or adjusted under 35 U.S.C. 154(b) by 58 days.

(21) Appl. No.: 14/053,515

(22) Filed: Oct. 14, 2013

(65) Prior Publication Data

US 2015/0105169 A1 Apr. 16, 2015

(51) Int. Cl.
*A63G 9/00* (2006.01)
*A47D 13/00* (2006.01)

(52) U.S. Cl.
CPC ..... *A63G 9/00* (2013.01); *Y10T 29/49716* (2015.01)

(58) Field of Classification Search
CPC ..... A63G 9/00; A63G 9/10; A63G 9/12; A63G 13/00; A63G 13/02; A47D 13/00; A47D 13/10; A47D 13/105; A47D 13/107
USPC ..... 472/118–125; 297/273, 274
See application file for complete search history.

(56) References Cited

U.S. PATENT DOCUMENTS

| | | | | | |
|---|---|---|---|---|---|
| 1,975,262 | A | * | 10/1934 | Evans et al. | 248/339 |
| 4,014,540 | A | * | 3/1977 | Caulkins | 472/14 |
| 4,066,258 | A | * | 1/1978 | Yates | 472/118 |
| 5,338,260 | A | * | 8/1994 | Smith | 472/118 |
| 5,403,637 | A | * | 4/1995 | Pickard et al. | 428/44 |
| 6,443,668 | B1 | * | 9/2002 | Streuer et al. | 405/302.7 |
| 6,814,120 | B1 | * | 11/2004 | Nguyen et al. | 152/517 |

FOREIGN PATENT DOCUMENTS

DE 29617169 * 1/1997

OTHER PUBLICATIONS

Google Search for "car tire images".
http://www.swingsetstuff.com/products/POLYMER-BELT-SWING-SEAT.html.

* cited by examiner

*Primary Examiner* — Kien Nguyen
(74) *Attorney, Agent, or Firm* — Rathe Lindenbaum LLP

(57) ABSTRACT

A belt swing comprises a belt having a front edge, a rear edge, a first end and a second end for attaching to suspension lines, a lower surface and an upper seating surface. A plurality of treads are on the upper seating surface.

19 Claims, 5 Drawing Sheets

BELT TIRE SWING

BACKGROUND

Parks, playgrounds and residences frequently include a swing. Belt swings typically comprise a flat belt suspended at opposite ends and upon which a person is seated during swinging. Tire swings typically comprise an entire tire suspended in a vertical or horizontal orientation and upon which a person is seated during swinging.

DETAILED DESCRIPTION OF THE EXAMPLE EMBODIMENTS

Figure 1:
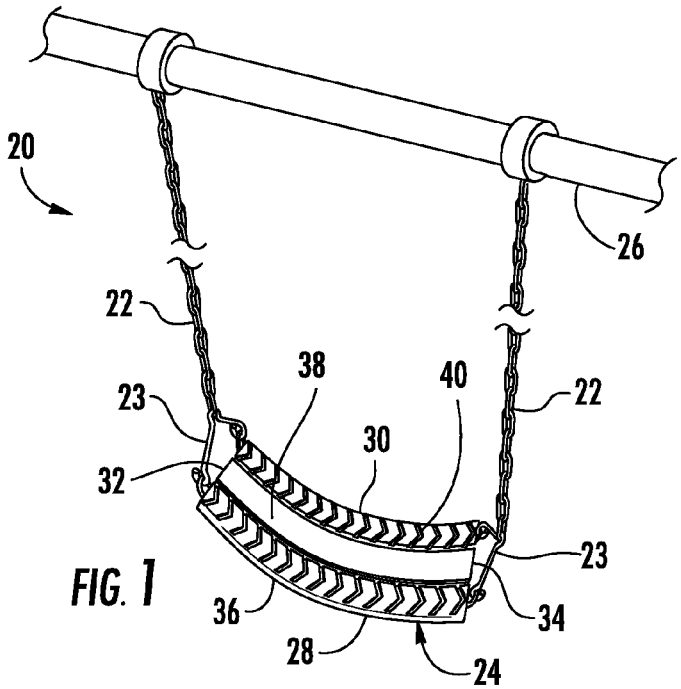
FIG. 1 is a perspective view of an example belt swing.

FIG. 1 illustrates an example belt swing 20. As will be described hereafter, belt swing 20 provides a seating surface which reduces rider slippage. Belt swing 20 provides a treaded upper concave surface, wherein the treads provide an aesthetically attractive upper seating surface, resembling vehicle tire treads, while reducing rider slippage. In one implementation, the tire treads of belt swing 20 visibly indicate and promote that belt swing 20 is formed from recycled used tires.

As shown by FIG. 1, belt swing 20 comprises suspensions 22, suspension connectors 23 and belt 24. Suspensions 22 comprises flexible elongate members configured to extend from and support opposite ends of belt 24 from an overhead support 26. Support 26 may comprise a tree limb, horizontal poster other horizontal structure. Suspensions 22 may comprise cable, rope, chains and the like.

Suspension connectors 23 comprise structures coupled to offset ends of belt 24 to connect the opposite ends of belt 24 to suspensions 22. In one implementation, suspension connectors 23 comprise brackets or other structures fastened to, molded within our otherwise secured to the opposite ends of belt 24. In one implementation, suspension connectors 23 may comprise apertures formed within belt 24 through which suspensions 22 extend and are knotted or by which suspensions 22 are otherwise connected to belt 24.

Belt 24 comprises an elongate band, wide strap or panel formed from one or more members. Belt 24 comprises a front edge 28, a rear edge 30, a first end 32, a second end 34, a lower surface 36 and an upper concave seating surface 38. Upper concave seating surface 38 faces upward in a generally concave arcuate plane. Upper concave seating surface 38 comprises a plurality of treads 40.

Treads 40 comprise a plurality of ribs and channels formed on upper seating surface 38. Treads 40 provide enhanced gripping or friction to inhibit slippage of riders. While providing enhanced gripping or friction, treads 40 allow substantial portions of upper seating service 38 to remain flat and smooth, providing seating comfort (as compared to a multitude of dimples). In one implementation, treads 40 inhibit both forward and rearward slippage as well as sideways slippage, providing the rider with a more secure and less fearful ride. Treads 40 may be especially beneficial for children. In one implementation, belt 40 is formed from previously used recycled vehicle tires. In one such implementation, treads 40 are configured to resemble a vehicle tire, visibly indicating that belt 24 is formed from a recycled tire.

Figure 2:
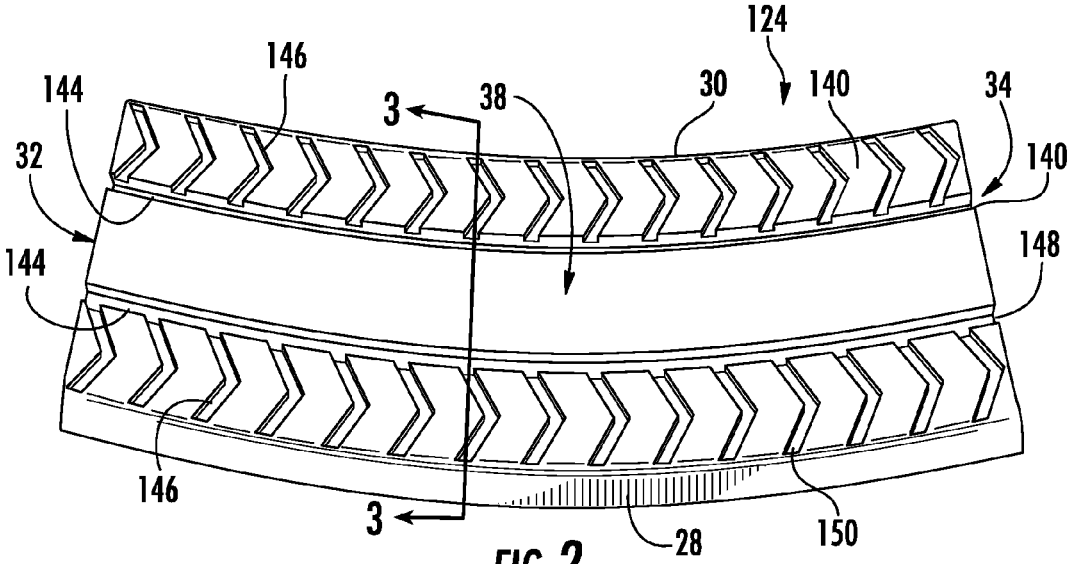
FIG. 2 is a perspective view of an example belt for a belt swing.
Figure 3:
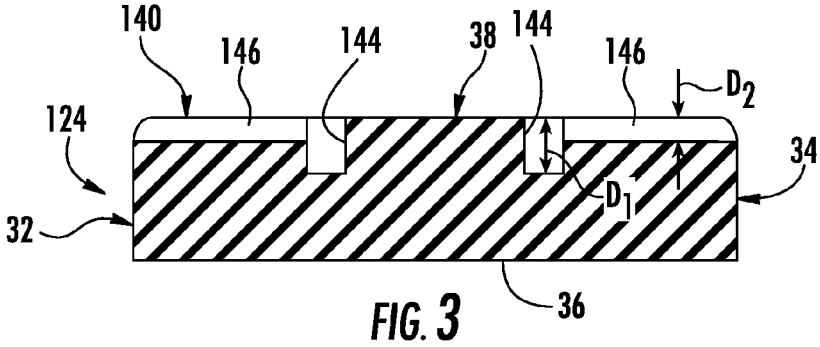
FIG. 3 is a sectional view of the belt of FIG. 2 take along line 3-3.

FIGS. 2 and 3 illustrate belt 124, a particular example of belt 24. Belt 124 is similar to belt 24 except that belt 124 is illustrated as having an upper seating surface 38 having the specifically illustrated treads 140. Belt 124 comprise a single structure integrally formed as a single unitary body, wherein the upper seating service 38 and a lower surface 36 of belt 124 are all formed as a single homogenous polymeric or rubber-like material. In other implementations, belt 124 may be formed from multiple pieces affixed or secured to one another in a permanent or a releasable fashion. Those portions of belt 124 which correspond to portions of belt 24 are numbered similarly.

As shown by FIG. 2, treads 140 may resemble the treads of a vehicle tire. Treads 140 comprise longitudinal channels 144 and transverse channels 146. Longitudinal channels 144 extend from first end 32 to second end 34. In the example illustrated, longitudinal channels 144 extend parallel to front edge 28 and rear edge 30, providing enhanced resistance against slippage in directions perpendicular to front edge 28 and rear edge 30. As a result, longitudinal channels 144 enhanced slippage resistance to inhibit a rider from slipping off of the front edge 28 or the rear edge 30 of belt 124.

In one implementation, longitudinal channels 144 are continuous, opening at each of ends 32, 34 at openings 148, permitting any water or other liquid within channels 144 to flow through such openings 148 at the ends of the channels. In yet other implementations, the ends of channels 144 may be closed.

Transverse channels 146 extend between longitudinal channels 144 and either the front edge 28 or the rear edge 30 of belt 124. In the example illustrated, transverse channels 146 obliquely extend between longitudinal channels 144 and either the front edge 28 of the rear edge 30 of belt 124. Because transverse channels 146 extend along centerlines oblique to longitudinal channels and 144 as well as oblique to the front edge 28 and the rear edge 30, transverse channels 146 not only resist sideways slippage towards and away from side edges 32, 34, but also provide additional resistance against forward and rearward slippage. Moreover, because transverse channels 146 extend oblique to the front edge 28 and the rear edge 30, transverse channels 146 are less likely to cut into a person's contacting anatomy or clothes and provide a more comfortable seating surface. In the example illustrated, transverse channels 146 comprise multiple angled sections, providing an even more comfortable seating surface. Although illustrated as being pointed, transverse channels 146 may be wavy or curved to resist slippage while at the same time providing seating comfort.

In the example illustrated, longitudinal channels 144 continuously extend from one of longitudinal channels 144 and either the front edge 28 or the rear edge 30. Transverse channels 146 open into the interior of a longitudinal channel 144 and open along the front edge 28 in the rear edge 30 of belt 124 at openings 150. As a result, water or other liquid may flow from the interior of channels 146 off of and away from the upper seating surface 38. In other implementations, transverse channels 146 may be closed.

FIG. 3 is a sectional view of belt 124. As shown by FIG. 3, longitudinal channels 144 have a first depth D1 while transverse channels 146 and a second depth D2 different than the first depth D1. In one implementation, channels 144, 146 each have a depth of at least 1/16 of an inch and nominally at least 1/4 of an inch for sufficient grip. Each of channels number 144, 146 have a depth of no greater than 1/2 of an inch for purposes of flexibility, material conservation and seating comfort.

In the example illustrated, channels 144 have a greater depth D1 than depth D2. As a result, channels 144 provide enhanced resistance against rider slippage, especially in implementations where longitudinal channels 144 extend parallel to front edge 28 and rear edge 30 (shown in FIG. 2), perpendicular to forward and rearward slippage directions. Although channels 144 have a greater depth, because the channels are centrally located between frontage 28 in rear edge 30, such channels 144 are more likely to underlie the center of a person's seating anatomy, less likely to cut or grip into the person's anatomy. Because transverse channels 146, which extend adjacent to front edge 28 and rear edge 30 are provided with a shallower depth D2, transverse channels 146 are less likely to receive and cut into a person's anatomy, providing more comfortable seating surface. In other implementations, channels 144, 146 may have other depths and depth relationships. In yet other implementations, upper seating surface 38 may have a greater or fewer of such different channel configurations.

Figure 4A:
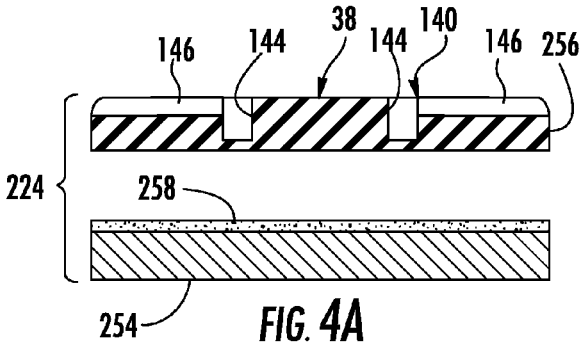
FIG. 4A is an exploded sectional view of another example belt for a belt swing.
Figure 4B:
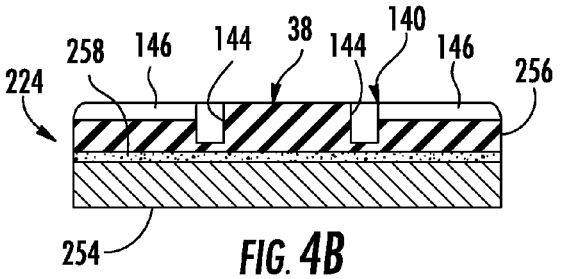
FIG. 4B is an assembled view of the belt of FIG. 4A.

FIGS. 4A and 4B are sectional views illustrating belt 224. Belt 224 is similar to belt 124 except that belt 224 is specifically illustrated as being formed from a multi-piece assembly. Belt 124 comprises lower belt support substrate 254 and upper treaded cover or treaded top 256. Lower belt support substrate 254 comprises a band of rubber, rubber-like, polymeric or fabric material which serves as a base or foundation for treaded top 256. Support substrate has sufficient strength and flexibility to support the weight of a swing rider with the upper surface of substrate 254 bending into an upwardly concave panel or plane.

Treaded top 256 comprises a panel to be secured or affixed to an upper face of lower belt support substrate 254. Treaded top 256 provides upper gripping surface 38 (described above). Treaded top 256 provides treads 140 having grooves or channels 144 and 146 (described above). In the example illustrated, channels 144, 146 do not extend completely through treaded top 256, providing a continuous lower surface for being secured to substrate 254. In other implementations, channels 144, 146 may extend completely through top 256.

In the example shown FIGS. 4A and 4B, treaded top 256 is secured to an upper face of substrate 254 by an adhesive 258. In other implementations, treaded top 256 may be secured to the upper face of substrate 254 by welding, fusing, resilient interlocking structures, fasteners and the like. In some implementations, substrate 254 and treaded top 256 may be comolded with one another. The construction of belt 224 facilitates the formation of belt 224 from multiple pieces or materials having different material characteristics or sources. For example, in one implementation, treaded top 256 may be formed from a softer, more resiliently flexible rubber-like material as compared to stronger and more durable material of substrate 254 to provide durability as well as enhanced rider slippage resistance. In one implementation, one of substrate 254 and treaded top 256 may be formed from recycled ground previously used tires while the other of suffering 254 and treaded top 256 is formed from materials not derived from used tires, but possibly possessing more preferable durability, color, friction, weight, cost, availability, strength or other characteristics. The multi-piece nature of belt 224 further facilitates customization, allowing different treaded tops 256 to be inventoried and assembled as needed (or demanded by consumers) to the underlying foundational substrate 254.

Figure 5A:
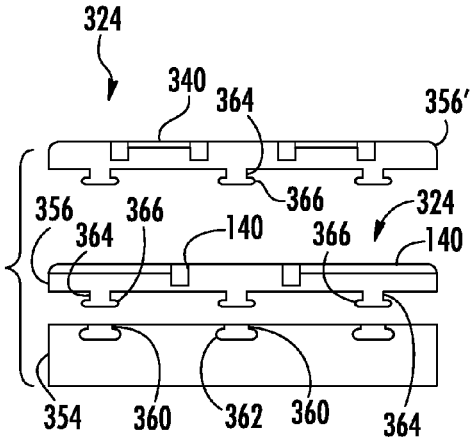
FIG. 5A is an exploded view of an example belt system for a belt swing, illustrating a substrate and two interchangeable treaded tops.
Figure 5B:
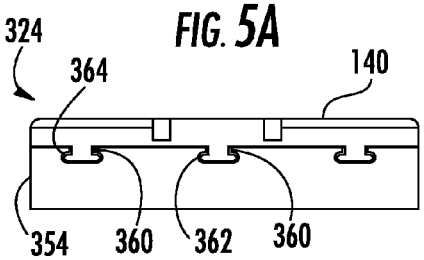
FIG. 5B is a sectional view of the substrate of FIG. 5A mounted to one of the treaded tops of FIG. 5A.

FIGS. 5A and 5B are sectional views illustrating belt 324, another implementation of belt 124. Like belt 224, belt 324 is a multi-peace belt comprising lower belt support substrate 354 and treaded top 356. Substrate 354 and top 356 are similar to substrate 254 and top 256, respectively, except that substrate 354 and top 356 are releasably mounted, secured or attached to one another by resilient interlocking clips or tabs. In the example illustrated, substrate 354 comprises an arrangement of cavities 360 having widened portions 362 while top 356 comprises correspondingly located, sized and configured posts 364 and ears 366. Post 364 and ears 366 flex during insertion into cavities 360 until ears 364 resiliently return or snap to a default state, being received within widened portions 362 to releasably secure and retain top 356 to substrate 354 as shown by FIG. 5B. During separation of top 356 from substrate 354, ears 364 resiliently flex until post 364 and ears 366 are withdrawn from cavity 360.

As with belt 224, belt 324 facilitates the formation of belt 324 from multiple pieces or materials having different material characteristics or sources. For example, in one implementation, treaded top 356 may be formed from a softer, more resiliently flexible rubber-like material as compared to stronger and more durable material of substrate 354 to provide durability as well as enhanced rider slippage resistance. In one implementation, one of substrate 354 and treaded top 356 may be formed from recycled ground previously used tires while the other of substrate 354 and treaded top 356 is formed from materials not derived from used tires, but possibly possessing more preferable durability, color, friction, weight, cost, availability, strength or other characteristics. The multi-piece nature of belt 324 for further facilitates customization, allowing different treaded tops 356 to be inventoried and assembled as needed (or demanded by consumers) to the underlying foundational substrate 354.

As further shown by FIG. 5A, the releasable connection provided by belt 324 further facilitates replacement or the interchange of different treaded tops 356. For example, as an individual treaded top 324 becomes worn or as the result of the rider becoming older and desiring a different treaded top having a different tread (or one even without treads), the existing treaded top 356 may be removed and replaced by a different treaded top. In the example illustrated, treaded top 356 may be selectively replaced with treaded top 356'.

Treaded top 356' has the same lower releasable connection configuration (tongues, grooves, posts or cavities) as the treaded top 356 being replaced, but has a different tread 340 as compared to tread 140. Belt 324 facilitates customization of belt swing 324 by allowing a selected top having a selected tread, a selected color, a selected softness or hardness and the like to be simply snapped (in the example shown in FIGS. 5A and 5B) or slid (as with a tongue and groove arrangement) into place.

Figure 6A:
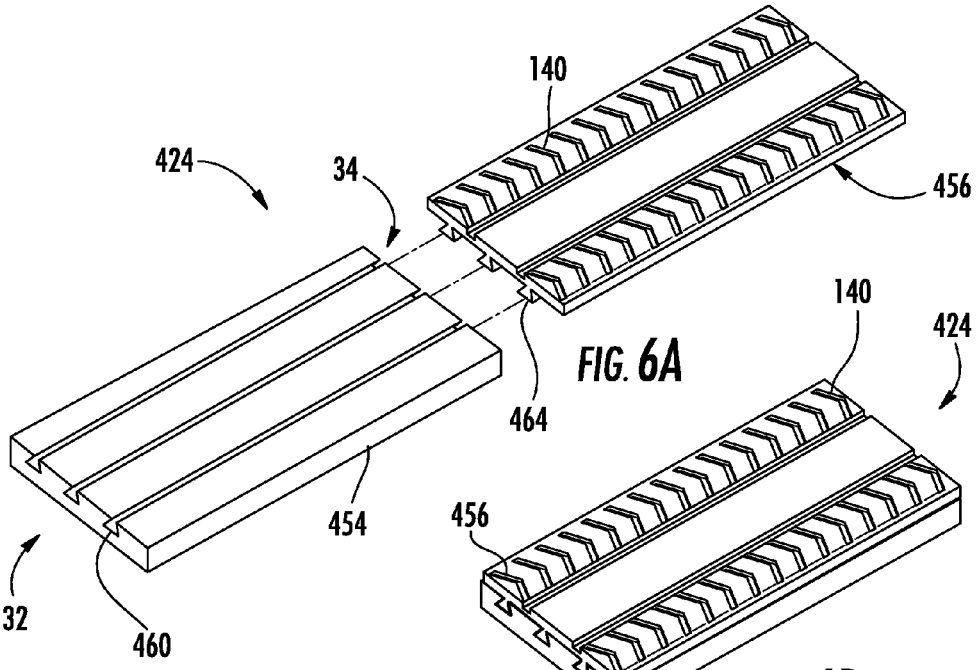
FIG. 6A is an exploded view of another example belt system for a belt swing.
Figure 6B:
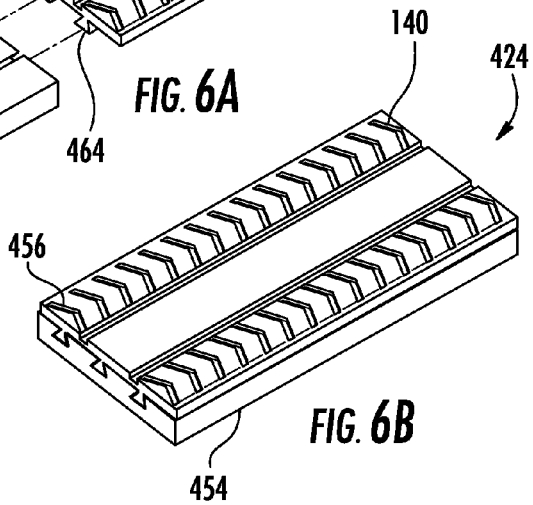
FIG. 6B is a perspective view of the belt system of FIG. 5C.

FIGS. 6A and 6B illustrate belt 424, another implementation of belt 124. Like belt 324, belt 424 is a multi-peace belt comprising lower belt support substrate 454 and treaded top 456. Substrate 454 and top 456 are similar to substrate 354 and top 356 except that substrate 454 and top 456 are releasably mounted, secured or attached to one another by a tongue and groove arrangement. In the example illustrated, substrate 454 comprises longitudinal tongue-shaped channels or grooves 460 extending from at least one end 32, 34, wherein the longitudinal grooves receive corresponding tongues 464 projecting from an underside of treaded top 456. In such an arrangement, suspension connectors 23 and suspensions 22 (shown in FIG. 1) may extend from substrate 454 such that one or both of connectors 23 and suspensions 22 engage and contact lateral ends of treaded top 456 (above ends 32, 34) to inhibit lateral or sideways movement of treaded top 456 and retain treaded top 456 in place upon substrate 454 when connected to substrate 454. In one implementation, one or both of grooves 460 and tongues 464 may be coated or otherwise provided with a low friction interface, such as Teflon or the like, to facilitate sliding reception of tongues 464 within grooves 460.

For each of the releasable interlocking arrangements described above with respect to belt swing system 324 and belt swing system 424, the relationship between the various components may be reversed. For example, cavities 360 and widening portion of the 362 may be formed on the underside of treaded top 356 while post 364 and ears 366 may project from an upper surface of substrate 354. Grooves 460 may be formed on the underside of treaded top 456 while tongues 464 project from an upper side of substrate 454.

Figure 7:
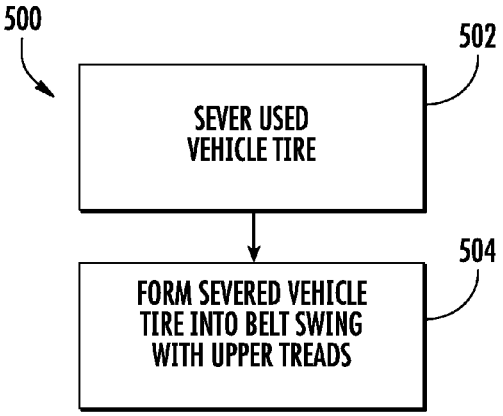
FIG. 7 is a flow diagram of an example method for forming a belt swing.

As noted above, in some implementations, the treads 40, 140, 340 may be used to provide a very visible indication of the recycled source of material for the belt swing, a recycled used vehicle tire. FIG. 7 is a flow diagram illustrating an example method 500 performing any of belts 24, 124, 224, 324 by recycling a used vehicle tire. As indicated by step 502, a used vehicle tire is severed or cut in some fashion such that it is no longer a complete tire. Examples of used vehicle tires that may be utilized include automobile, truck, tractor and other vehicle tires. As indicated by step 504, the severed used vehicle tire is then formed into one of belt 24, 124, 224, 324 such that the belt has upwardly facing tire treads on the concave seating surface of the belt.

Figure 8:
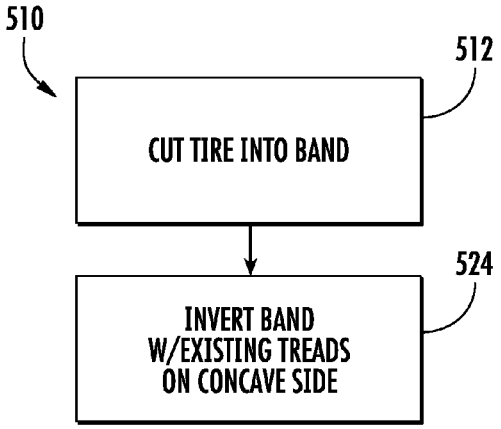
FIG. 8 is a flow diagram of another example method for forming a belt swing.
Figure 9A:
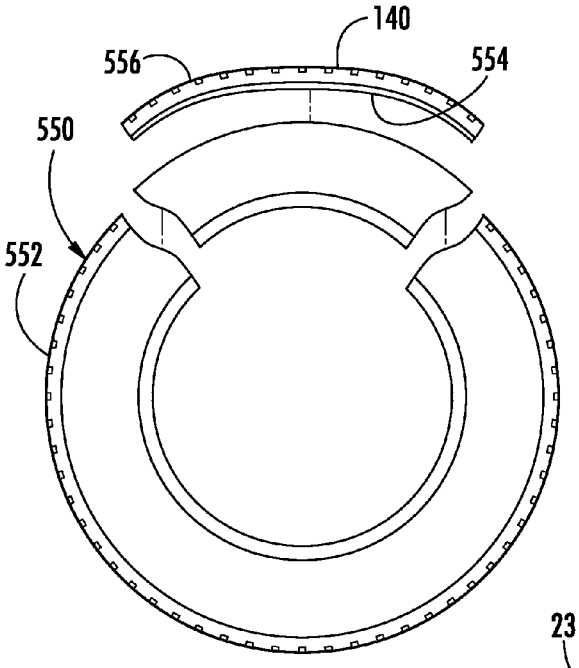
FIG. 9A is a side elevational view illustrating cutting a used vehicle tire into a band performing a belt for a belt swing.

FIG. 8 is a flow diagram of method 510, a particular example implementation of method 500. As indicated by step 512, the used vehicle tire is severed so as to cut the use vehicle tire into a band 554. FIG. 9A illustrates the severing of a used vehicle tire 550 having an existing circumferentially extending tire tread 140 into a band 554 comprising an outer circumferential portion of tire 550 and of tread 140. As shown by FIG. 9A, the band, after being cut from tire 550, has a convex outwardly facing outer circumferential surface 556 which includes the previously existing treads 140. In one implementation, the original used vehicle tire 550 comprises non-radial steel belt tire, such that the tire does not include steel or wire strands. In one implementation, the original vehicle tire 550 and the resulting band 554 have embedded nylon threads or other nonmetallic windings or threads 558 (shown in FIG. 9B) embedded therein.

Figure 9B:
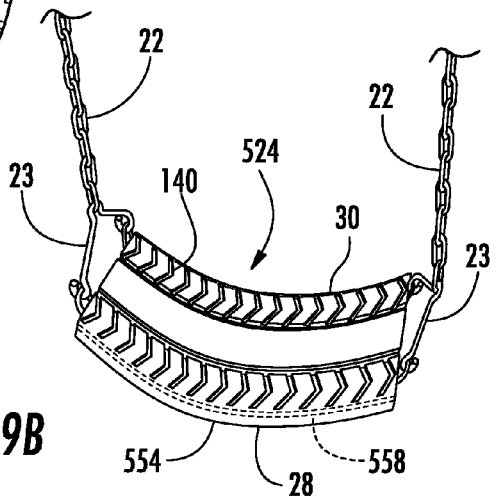
FIG. 9B is a side elevational view illustrating inverting of the band of FIG. 8 to form the belt swing.

As indicated by step 514 in FIG. 8, the cut and separated band 554 with the existing treads 552 is inverted such that the treaded surface containing treads 140 is a longer convex, but is concave, facing upwardly. FIG. 9B illustrates band 554 after being inverted and mounted to connectors 23 and suspensions 22. Because band 554 is inverted from its original shape, band 554, forming the belt 524, is less likely to dig into a person's skin along the front edge 28 and rear edge 30.

Figure 10:
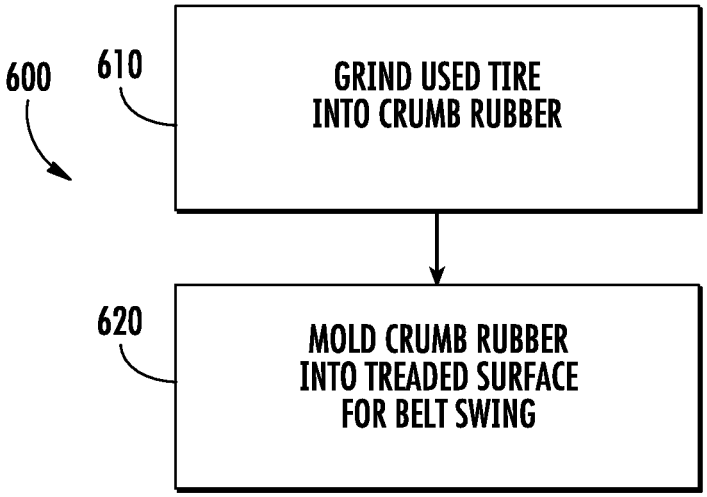
FIG. 10 is a flow diagram of another example method for forming a belt swing.

FIG. 10 is a flow diagram of method 600, another example implementation of method 500. As indicated by step 610, the used vehicle tire is severed by grinding, dicing, mulching or performing some other material process by which the use vehicle tire is severed into crumb rubber, small enough particles of the use rubber for melting or fusing and subsequent forming or molding. Such processing may comprise the removal of steel and fluff, leaving tire rubber with a granular consistency. Further processing with a granulator and/or cracker mill (possibly with data cryogenics or mechanical means), may further reduce the size of the particles. Such powders may be granular or mesh. For purposes of this disclosure, the term "grind" encompasses all material process by which an existing tire is severed into smaller chunks or particles for subsequent melting and/or fusing and molding.

Figure 11:
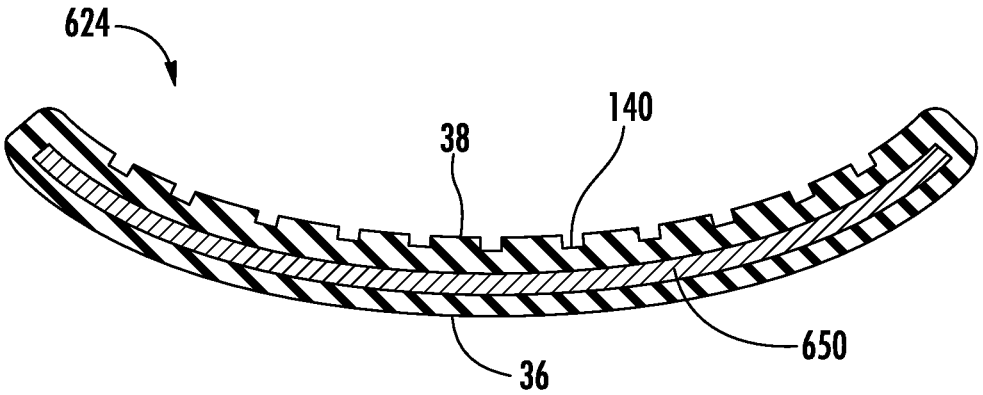
FIG. 11 is a sectional view of another example belt for a belt swing.

As indicated by step 620, the crumb rubber or other rubber granular is molded into the treaded surface for the belt swing. In one implementation, the crumb rubber may be molded into belt 124. In another implementation, the crumb rubber may be molded into substrate 254, substrate 354, substrate 454, treaded top 256, treaded top 356, 356' and/or treaded top 456 (and other interchangeable treaded tops for substrate 454). As shown by FIG. 11, in yet another implementation, the crumb rubber may be overmolded about an insert 650 (serving as a substrate) to form belt 624, another implementation of belt 24. The overmolded crumb rubber forms the lower surface 36 and the upper seating surface 38 having treads 140. In such an implementation, the majority of belt 624 may be formed from the recycled crumb rubber material while the insert 650 is far from a different material having desired characteristics which contrast with the characteristics of the molded crumb rubber. For example, insert may provide additional strength, resiliency or the like for belt 624.

Figure 12:
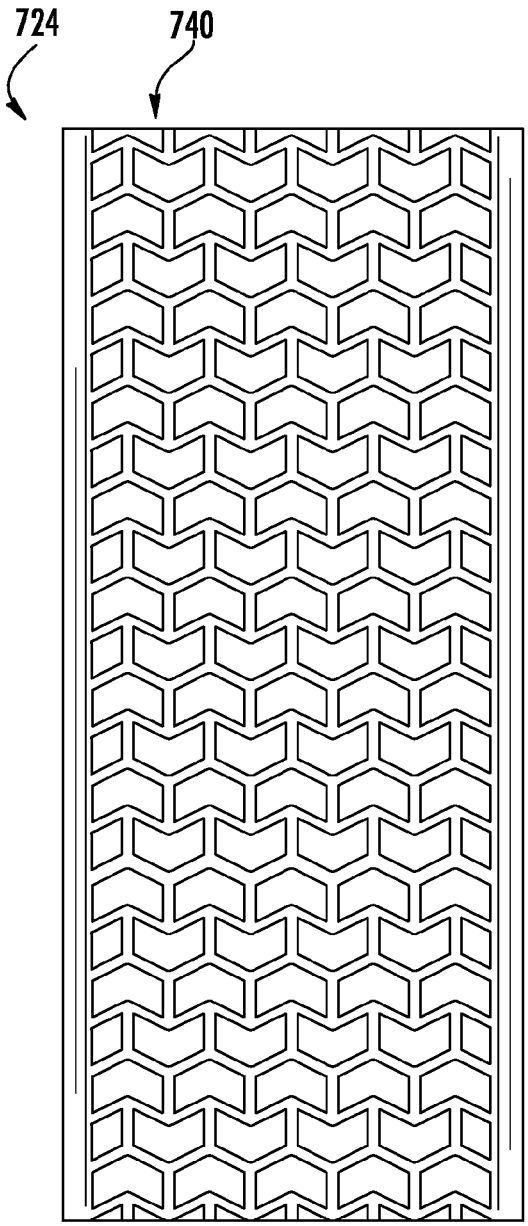
FIG. 12 is a top plan view of another example belt swing belt having an example tread pattern.
Figure 13:
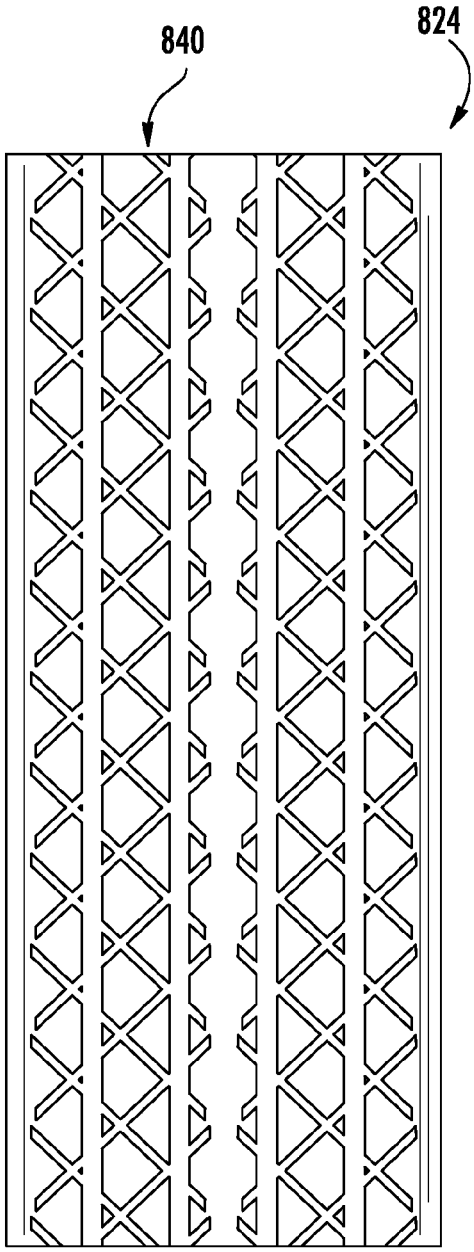
FIG. 13 is a top plan view of another example belt swing belt having another example tread pattern.

In the above examples, specific tread configurations are disclosed. In other implementations, belts 24, 124, 224, 324, 524 and 624 may have other tread patterns. FIGS. 12 and 13 are top views illustrating alternative belts 724 and 824, respectively. Belts 724 and 824 are similar to belts 124, 224, 324, 424, 524 or belt 624 except that belts 724 and 824 include different treaded surfaces. Belt 724 is illustrated as comprising treads 740 while belt 824 is illustrated as comprising treads 840. Treads 740 offer greater side to side resistance against writer slippage. Treads 840 offer greater slip resistance in both rearward/forward and sideways directions. In yet other implementations, other tread patterns may be employed with belts 124, 224,324, 424, 524, 624 for slip resistance as well as possibly indicating the use of recycled tires.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A belt swing comprising:

a flexible belt comprising a panel having a front edge, a rear edge, a first end edge and a second end edge for attaching to suspension lines, a lower surface and an upper seating surface, the lower surface and the upper seating surface separated by a thickness of the belt, wherein the front edge and the rear edge each have a height defined by the thickness; and a plurality of treads on the upper seating surface.

2. The belt swing of claim 1, wherein the treads are integrally formed as a single unitary body with the upper seating surface.

3. The belt swing of claim 1, wherein the treads have a depth of at least 1/16 of an inch.

4. The belt swing of claim 1, wherein the treads have a depth of at least 1/4 of an inch.

5. The belt swing of claim 1, wherein the treads comprise:

a continuous longitudinal channel extending from the first end to the second end; and a plurality of transverse channels extending between the longitudinal channel and one of the rear edge and the front edge, and wherein the transverse channels extend oblique to the longitudinal channel.

6. The belt swing of claim 1, wherein the treads comprise a first tread portion having a first depth and a second tread portion having a second depth different than the first depth.

7. The belt swing of claim 1 further comprising a plurality of nylon threads embedded in the belt.

8. The belt swing of claim 1, wherein the belt comprises molded crumb rubber from a used vehicle tire.

9. The belt swing of claim 1 comprising a panel comprising the treads, the panel affixed to the upper seating surface of the belt.

10. The belt swing of claim 1, wherein the upper seating surface is configured to be concave when suspended prior to being sat upon.

11. The belt swing of claim 1 comprising an inverted portion of a vehicle tire, the inverted portion of the vehicle tire forming the belt and the plurality of treads.

12. The belt swing of claim 1, wherein the belt comprises a substrate and wherein the plurality of treads are provided by a treaded top coupled to the substrate.

13. A method comprising:

severing a used vehicle tire;

forming the severed vehicle tire into a belt swing having an upper concave seating surface comprising treads, wherein the treads comprise:

a continuous longitudinal channel extending from the first end to the second end; and a plurality of transverse channels extending between the longitudinal channel and one of the rear edge and the front edge, wherein the severing comprises cutting the used vehicle tire into a band and wherein forming the severed vehicle tire comprises inverting the band such that existing treads of the used vehicle tire face upward to form the upper concave seating surface.

14. The method of claim 13, wherein severing the vehicle tire comprises grinding the vehicle tire into crumb rubber and wherein forming the severed vehicle tire comprises molding the crumb rubber into a treaded surface comprising the treads for the belt swing.

15. The method of claim 13, wherein the treads comprise a first tread portion having a first depth and a second tread portion having a second depth different than the first depth.

16. A method comprising:

severing a used vehicle tire by grinding the vehicle tire into crumb rubber;

forming the severed vehicle tire into a belt swing having an upper concave seating surface by molding the crumb rubber into a treaded surface comprising treads, wherein the treads comprise:

a continuous longitudinal channel extending from the first end to the second end; and a plurality of transverse channels extending between the longitudinal channel and one of the rear edge and the front edge; and securing the treaded surface to a belt substrate panel.

17. A belt swing comprising:

a belt having a front edge, a rear edge, a first end and a second end for attaching to suspension lines, a lower surface and an upper concave seating surface;

a plurality of treads on the upper concave seating surface; and an inverted portion of a vehicle tire, the inverted portion of the vehicle tire forming the belt and the plurality of treads.

18. A belt swing comprising:

a belt having a front edge, a rear edge, a first end and a second end for attaching to suspension lines, a lower surface and an upper seating surface; and a plurality of treads on the upper seating surface, wherein the treads comprise:

a continuous longitudinal channel extending from the first end to the second end; and a plurality of transverse channels extending between the longitudinal channel and one of the rear edge and the front edge, wherein the belt comprises a substrate and wherein the plurality of treads are provided by a treaded top coupled to the substrate.

19. A belt swing comprising:

a belt having a front edge, a rear edge, a first end and a second end for attaching to suspension lines, a lower surface and an upper seating surface; and a plurality of treads on the upper seating surface, wherein the treads comprise:

a continuous longitudinal channel extending from the first end to the second end; and a plurality of transverse channels extending between the longitudinal channel and one of the rear edge and the front edge; and a panel comprising the treads, the panel affixed to the upper seating surface of the belt.

* * * * *